United States Patent [19]

Harsy

[11] Patent Number: 4,986,190

[45] Date of Patent: Jan. 22, 1991

[54] VEHICLE, PARTICULARLY TRACK VEHICLE

[75] Inventor: Gabor Harsy, Neuhausen, Switzerland

[73] Assignee: SIG Schweizerische Industrie-Gesellschaft, Switzerland

[21] Appl. No.: 328,739

[22] Filed: Mar. 23, 1989

Related U.S. Application Data

[63] Continuation of Ser. No. 29,639, Mar. 24, 1987, abandoned.

[30] Foreign Application Priority Data

Mar. 25, 1986 [CH] Switzerland ..... 1193/86

[51] Int. Cl.[5] ..... B61F 5/44

[52] U.S. Cl. ..... 105/4.4; 105/180; 280/2; 296/25; 296/203

[58] Field of Search ..... 296/25, 203, 179; 280/2; 105/396, 397, 180, 4.4, 133, 158.2, 329.1, 453, 26.05, 355; 180/291; 414/460

[56] References Cited

U.S. PATENT DOCUMENTS

| | | | |
|---|---|---|---|
| 1,880,953 | 10/1932 | Fageol | 105/4.4 |
| 2,225,242 | 12/1940 | Van Dorn et al. | 105/158.2 |
| 2,815,720 | 12/1957 | Baseler | 105/453 X |
| 2,846,954 | 8/1958 | Gaynor | 105/4.4 |
| 2,908,233 | 10/1959 | Furrer | 105/453 |
| 2,935,031 | 5/1960 | Cripe | 105/4.4 |
| 2,954,746 | 10/1960 | Cripe | 105/4.4 |
| 3,208,402 | 9/1965 | Bingham | 105/180 X |
| 4,143,781 | 3/1979 | Lenius et al. | 180/140 X |
| 4,393,955 | 7/1983 | Van Mullem | 296/179 X |
| 4,454,821 | 6/1984 | Dickhart | 105/4.4 |

FOREIGN PATENT DOCUMENTS

| | | | |
|---|---|---|---|
| 538024 | 12/1955 | Belgium | 105/4 R |
| 0058914 | 9/1982 | European Pat. Off. . | |
| 0129772 | 1/1985 | European Pat. Off. . | |
| 0135877 | 4/1985 | European Pat. Off. . | |
| 0181295 | 5/1986 | European Pat. Off. . | |
| 0183619 | 6/1986 | European Pat. Off. . | |
| 2512008 | 10/1975 | Fed. Rep. of Germany . | |
| 3342968 | 3/1984 | Fed. Rep. of Germany . | |
| 3409103 | 9/1985 | Fed. Rep. of Germany . | |
| 3427723 | 2/1986 | Fed. Rep. of Germany . | |
| 6700903 | 7/1968 | Netherlands | 414/460 |
| WO85/05602 | 12/1985 | PCT Int'l Appl. . | |
| 255289 | 1/1949 | Switzerland . | |

*Primary Examiner*—Stephen M. Hepperle
*Attorney, Agent, or Firm*—Ostrolenk, Faber, Gerb & Soffen

[57] ABSTRACT

A vehicle, preferably a track vehicle, having a body and wheels arranged in pairs at the sides of the body. The wheels of each pair are supported by a gantry-like frame having support elements extending upwardly from the wheels and a cross member located in the roof region of the body. This arrangement allows the vehicle floor between the wheels to be made quite low and allows the height of the floor to remain the same throughout the entire vehicle length. The wheels can be driven from a motor located in the roof region and are preferably steerable to some extent to allow necessary adjustment as the vehicle negotiates bends.

9 Claims, 9 Drawing Sheets

VEHICLE, PARTICULARLY TRACK VEHICLE

This is a continuation of application Ser. No. 29,639, filed on Nov. 24, 1987 now abandoned.

BACKGROUND OF THE INVENTION

I. Field of the Invention

The present invention relates to a vehicle, particularly a vehicle designed to travel on a track, having a continuous low lying vehicle floor and wheels arranged in pairs in single wheel chassis.

II. Discussion of Prior Art

A convenient entrance height, preferably one which does not require the use of steps, and a low lying vehicle floor extending therefrom and without changes of level for the entire length of the vehicle, are two constant requirements of today's track vehicles from the point of view of user convenience.

A further requirement, which is relevant from the operator's point of view, is that the track vehicle should run smoothly and that there should be little wear at the wheel/track connection. Such wear, particularly as the vehicle negotiates curves, makes itself noticeable in the form of constant squealing.

Up to the present, track vehicle designers have attempted to meet these requirements by adopting one of two different approaches.

(a) The use of bogies

It is known to locate the driven and non-driven wheels of track vehicles in rotatable bogies. The non-driven bogies may be equipped with wheels which have a small diameter which, according to EP 0 058 914, makes a lowering of the vehicle floor possible in this region.

The disadvantage of this arrangement is that a lowering of the vehicle floor in the region of the driven wheels is only possible at the sides of the vehicle body.

This means that unavoidable differences in height are produced between various zones within the vehicle interior which must be accommodated by the provision of interior steps.

It is desirable to provide vehicles equipped with bogies with a certain radial adjustability of the wheel set by resilient guide means so that the vehicle may run smoothly when negotiating curves. In order to achieve this effect, however, one of two known solutions is normally employed, namely mutual self steering of the wheel set or forced steering of the wheel set from the vehicle body.

An alternative to this is disclosed in DE-OS 34 27 723 which shows a bogie having steerable individual wheels, which are journalled in pairs from a rigid elongated axial shaft and are pivotable about a vertical axis at a point offset from the wheels. The actual steering operation is carried out by positioning elements which receive their impulses from a central computer installed in the vehicle.

This solution results in increased mechanical complexity for the steerable journalling of single wheels and for the implementation of steering of the single wheels suitable for use in track vehicles.

This prior invention is exclusively concerned with the reduction of noise and wear when the vehicle negotiates curves, so the question arises as to whether it could permit a convenient entrance height in the sense mentioned above since this is not the object of the application.

(b) The use of single axle chassis

Further vehicles are known which do without bogies of the conventional type and whose vehicle construction is supported, according to DE-OS 25 12 008, on single axle chassis.

The illustrated embodiment has a vehicle floor in the region of the chassis which lies at a level below the wheel diameters.

This reduction in level is achieved by a specially designed yoke, which acts as an axle substitute, in which the two single wheels are journalled. Furthermore, the yoke co-operates with the vehicle suspension.

The above case solves the problem of providing a suspension system which allows a vehicle to be transversely tilted about a rotational axis arranged far above the vehicle center of gravity.

Single wheel chassis having independent wheels which rotate on separate axles which are horizontally pivotable for the purpose of providing an ideal radial adjustment when negotiating curves, are shown in EP O 135 877 and DE-OS- 34 09 103, and a double arrangement of these free wheel chassis is also known according to DE-OS 33 42 968.

Although the above systems considerably reduce the directional force in curves and consequently the wear and noise generation at the wheel/rail connection, the not inconsiderable problem of undesirable tipping of the free wheel chassis on its small base remains.

The present invention has as its object the creation of driven and non-driven chassis of substantially identical construction, which enable the track vehicle to have a convenient entrance height and an extremely low vehicle floor over the entire length of the vehicle, and additionally provide the vehicle with good straight running characteristics as well as a pronounced wear reduction when negotiating curves.

SUMMARY OF THE INVENTION

According to the invention there is provided in a vehicle having a body with opposite sides, a roof region and wheels arranged in pairs with the wheels of each pair arranged at opposite sides of the body, the improvement which comprises supporting the wheels of each pair in a gantry-like frame comprising support members extending substantially upwardly from the wheels adjacent to the body sides and a cross member located in the roof region of the body.

The solution is preferably concerned with outer journalled single wheels which are guided on a wide base and are suspended from above and which can be provided with a novel drive arrangement The invention provides driven and/or non-driven single wheel chassis of substantially identical construction and permits the construction, in combination with a support and service unit, of a track vehicle having an extremely low vehicle floor which extends lengthwise of the vehicle and has a level below the middle points of the wheels.

DESCRIPTION OF THE PREFERRED EMBODIMENTS

Figure 1:
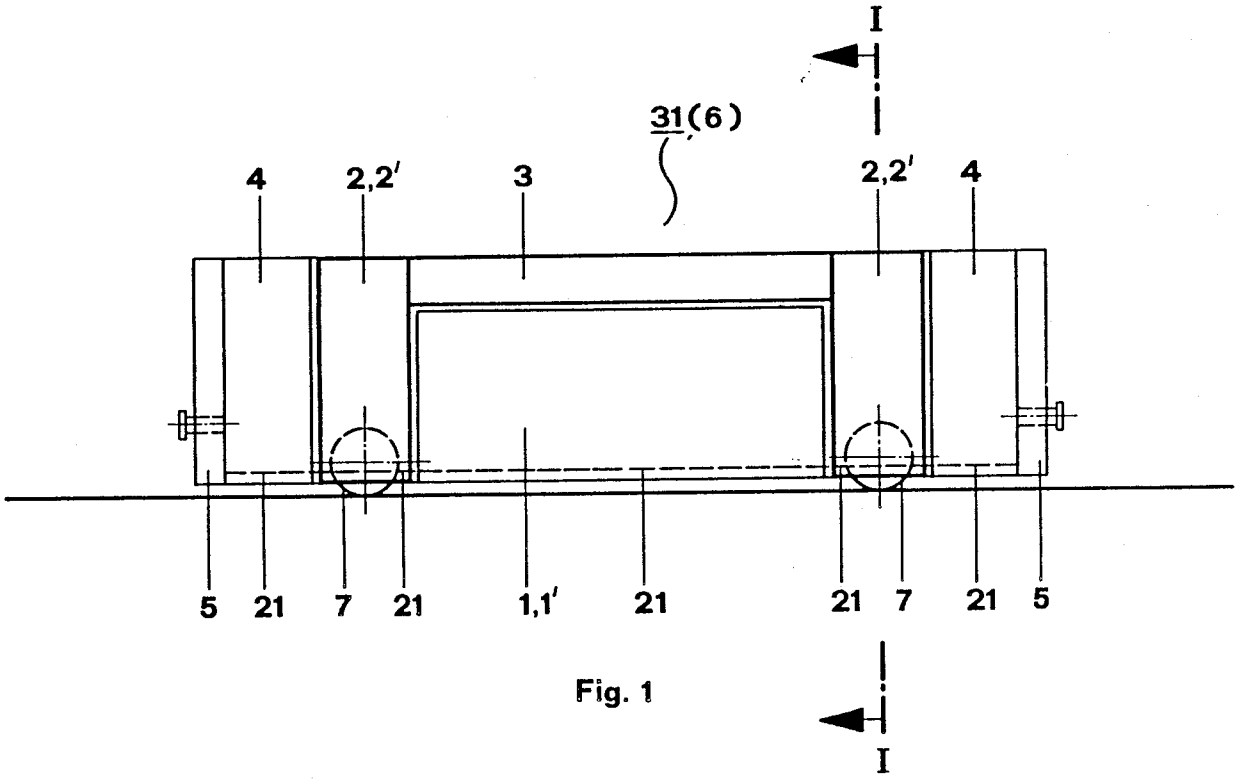
FIG. 1 is a side elevation in simplified form of a track vehicle of modular construction having gantry chassis.

A track vehicle shown in FIG. 1 consists essentially of a gantry-like frame 6 having a container-like passenger compartment 1 or freight compartment 1' suspended therebelow The gantry frame 6, for its part, consists of two driven single wheel chassis 2 or two non-driven single wheel chassis 2', or of one driven single wheel chassis 2 and one non-driven single wheel chassis 2', which in their upper regions are connected to a support and service unit 3 and as a whole form a self supporting and conveying unit. A track vehicle of this type has an extremely low vehicle floor 21 which extends for the complete vehicle length It lies at a level below the wheel centers and is trough shaped between the wheels 7 in the region of the driven single wheel chassis 2 and the non-driven single wheel chassis 2'. The support and service unit 3 of the gantry frame 6 serves to receive all operating equipment, such as drive equipment, cooling, electrical and compressed air units, wheel steering units, water supplies etc. At both ends of the gantry frame 6 an additional end unit 4 may be provided, which optionally contains an entrance, driver cab, washroom or telephone compartments. The end units 4 can be equipped with a coupling device 5 on their respective end faces which acts as linking elements with the next adjacent vehicles.

Figure 2:
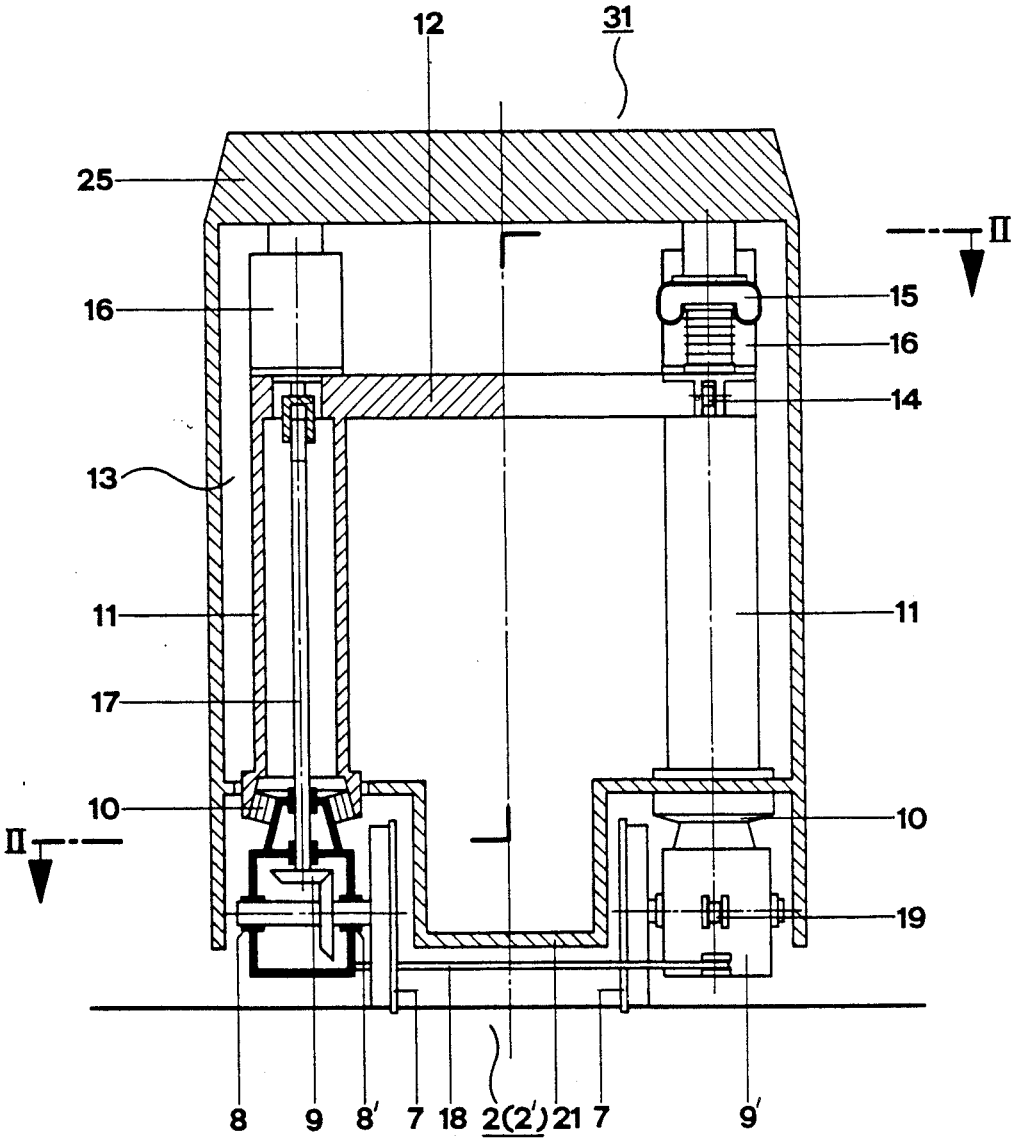
FIG. 2 is a cross-section on section line I—I of FIG. 1.
Figure 3:
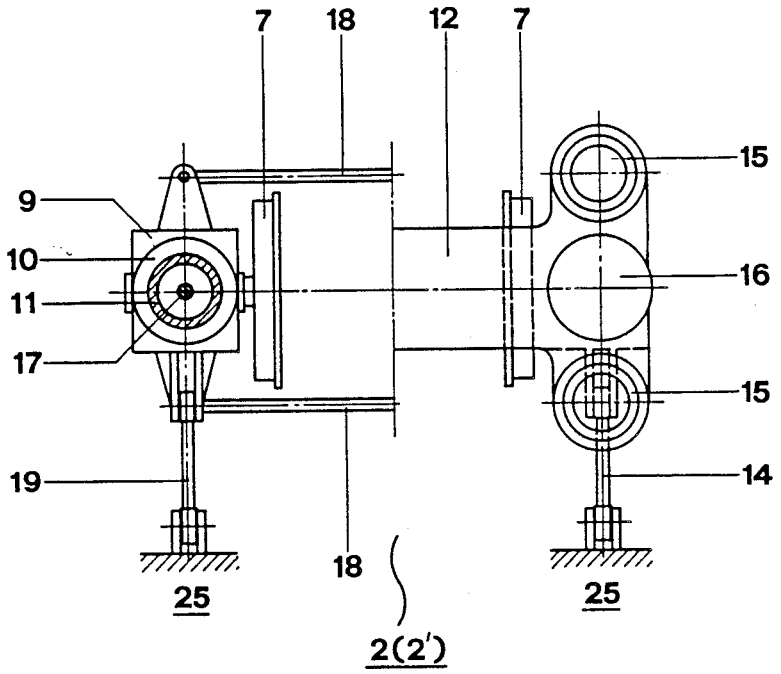
FIG. 3 is a cross-section of a gantry chassis on sectional line II—II of FIG. 2.

FIGS. 2 and 3 show the construction of a gantry frame 6 of the track vehicle of the invention in the region of its driven single wheel chassis 2 and non-driven single wheel chassis 2'. An outer journal 8, 8' of each driven single wheel 7 is combined with an angle drive 9 in the case of a driven single wheel chassis 2. A gantry frame 13 is supported above the angle drive via a primary suspension 10 and has vertical supports 11 and a horizontal yoke 12. Above the yoke 12, two support points for the vehicle body 25 are provided in the form of secondary suspensions 15. In the longitudinal direction of the vehicle, the yoke 14 is guided on the vehicle body 25 via two longitudinal guides 14. In the driven version, a drive motor 16 is vertically arranged on the gantry frame 13 for each single wheel 7.

A drive shaft 17 of the drive motor 16 is located in the support 11 and projects through the primary suspension 10 and is connected to the pinion of the angle drive 9, and an axial length compensation for suspension movements is provided. The angle drive 9 is connected to the angle drive 9' on the opposite side by gauge rods 18 which extend on both sides of single wheels 7. Additionally, each angle drive 9, 9' is supported in the longitudinal direction of the vehicle body 25 by further guide levers 19.

Figure 4:
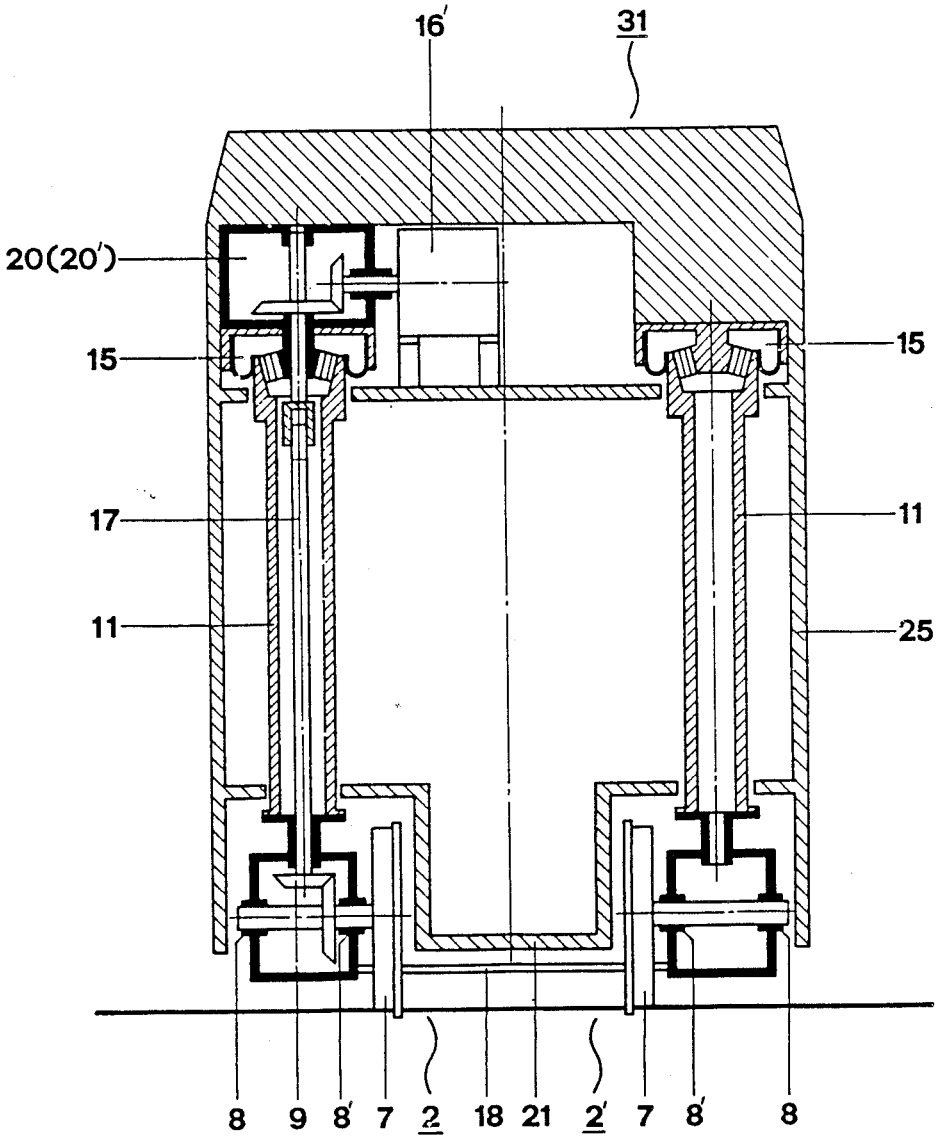
FIG. 4 is a single wheel chassis according to FIG. 2 (left driven/right non-driven) with a horizontal drive motor, without the primary suspension.

FIG. 4 shows a further embodiment from which the primary suspension has been omitted. In the left side of the Figure, a driven single wheel chassis is shown having a horizontal drive motor 16' located in the roof region of the vehicle body 25 which drives the drive shaft 17 extending on each side of the secondary suspension 15 via a further angle drive 20, 20' located above the secondary suspension 15. The drive shaft 17 lies within the vertical support 11 and has an axial length compensation for spring motion. It is also possible to locate a drive motor 16' in the roof region along the longitudinal vehicle axis and to drive both single wheels via a differential. In the right hand side of the figure, a non-driven single wheel chassis of largely identical construction is shown. In both cases, the single wheels 7 are also in this case guided on the track by cross-connection of the wheels via two gauge rods 18 and via guide levers 19 attached to the vehicle body 25.

Figure 5:
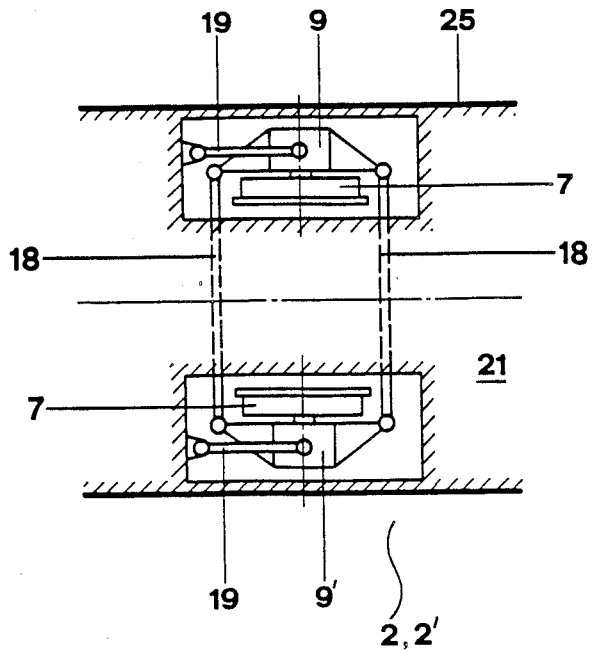
FIG. 5 is a plan view of a single wheel chassis with self regulating single wheels.

FIG. 5 shows, in schematic representation and in plan view, the guiding action of the two single wheels 7 by means of the two gauge rods 18 and the two guide levers 19 which form attachments to the vehicle body 25. Also clear from this representation is the trough shaped vehicle floor 21 located between the single wheels 7.

Figure 6:
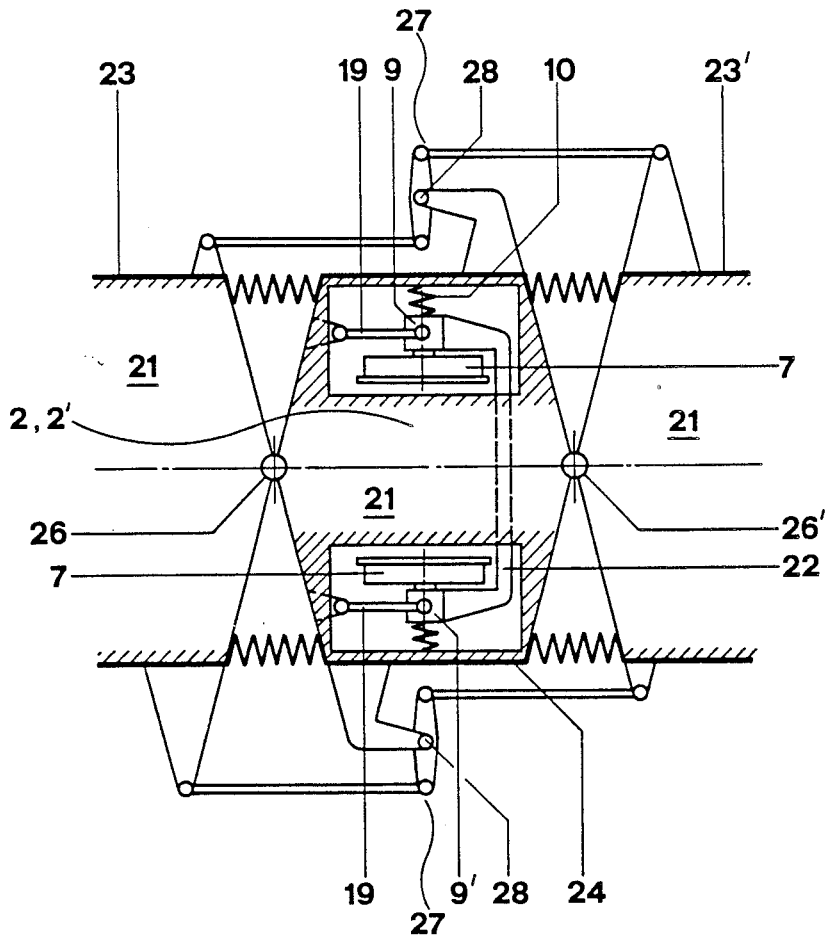
FIG. 6 is a plan view of a single wheel chassis with forced steering from the vehicle body side.

FIG. 6 shows the forced steering, which takes place from the side of the vehicle body, of a driven single wheel chassis 2 or a non-driven single wheel chassis 2' as an example of a multi-part, articulated vehicle. Two vehicle parts 23, each being of the type shown in FIGS. 1–5 and 9, and 23' are jointed together via a vehicle part 24 connected at joints 26, 26'. A driven single wheel chassis 2 or a non-driven single wheel chassis 2', whose single wheels 7 are fixed in a common track holder 22, is located below the vehicle part 24 and is attached to this by the guide lever 19 at each side. The steering geometry of the vehicle parts 23 and 23' is carried over to the driven single wheel chassis 2 or the non-driven single wheel chassis 2' via a steering-lever system 27 arranged on each side of the vehicle parts 23, 23' and 24, which system has a fixed point 28 on the vehicle part 24, and this causes the chassis to adopt a radial adjustment at the central point of the curve when the vehicle negotiates a bend.

It is also conceivable to arrange a forced guidance system of a driven single wheel chassis 2 or a nondriven single wheel chassis 2' in an articulated vehicle which consists of only the vehicle parts 23 and 24 joined together by joint 26. In this case, the steering-lever system 27 is arranged on both sides of the vehicle parts 23 and 24 having a fixed point 28 on the driven single wheel chassis 2 or the non-driven single wheel chassis 2'.

Figure 7:
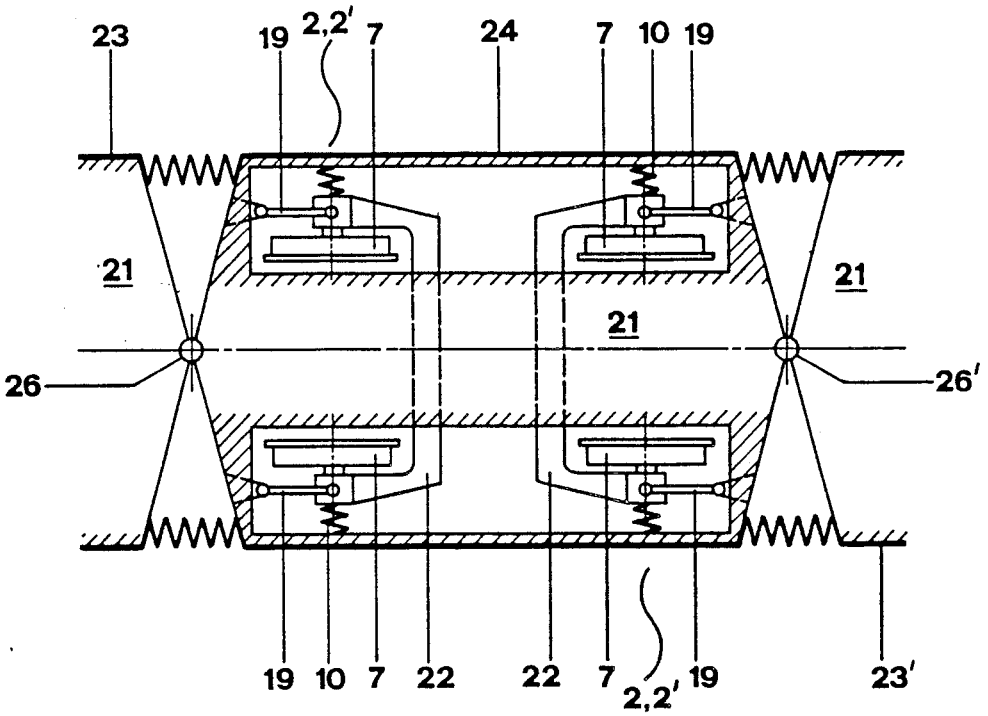
FIG. 7 is a plan view of a single wheel chassis in a tandem arrangement.
Figure 8:
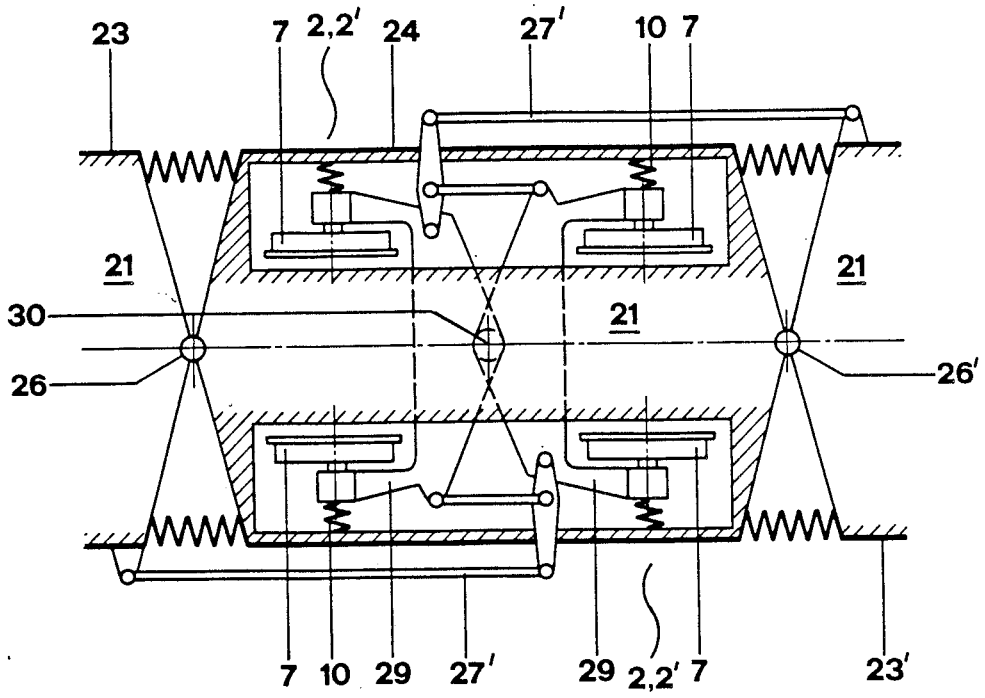
FIG. 8 is a plan view of a single wheel chassis in a tandem arrangement with forced steering from the vehicle body side.

FIGS. 7 and 8 show the use of driven single wheel chassis or non-driven single wheel chassis in a tandem arrangement, which may be used for example for long or heavy vehicles on the basis of the additional wheel loadings which must be accommodated.

FIG. 7 shows the arrangement of two driven single wheel chassis 2 or non-driven single wheel chassis 2' in the case of a multi-part articulated vehicle. Two vehicle parts 23 and 23', each being of the type shown in FIGS. 1–5 and 9, are attached together with the interposition of a vehicle part 24 via joints 26, 26'. Two driven single wheel chassis 2 or two non-driven single wheel chassis 2', whose two single wheels 7 are fixed in common track holders 22, are located under the vehicle part 24 and are attached to this via guide levers 19 on each side.

FIG. 8 shows the forced guidance in the double arrangement of driven single wheel chassis 2 or nondriven single wheel chassis 2' in an example of a multipart articulated vehicle. Two vehicle parts 23 and 23', each being of the type shown in FIGS. 1-5 and 9, are attached together via an interposed vehicle part 24 by joints 26, 26'. Two driven single wheel chassis 2 or two non-driven single wheel chassis 2' are located beneath the vehicle part 24 and whose individual wheels 7 are fixed in unitary coupling stirrups 29 and are rotatable about a vertical axis around a pivot bearing 30. The attachment between the two coupled driven single wheel chassis 2 or the two non-driven single wheel chassis 2' and the vehicle parts 23, 23' and 24 takes place via a guide-lever system 27' arranged rotationally symmetrically on both sides of the vehicle. The guide lever system unites the two coupled driven single wheel chassis 2 or the two non-driven single wheel chassis 2' on one side to each other and unites these (2, 2') either (on one side) with the vehicle part 23 or (on the other side) with the vehicle part 23'.

By this means, changes in alignment of the vehicle parts 23 and 23' are carried over to the tandem arrangement of the driven single wheel chassis 2 or the non-driven single wheel chassis 2' so that these may have a radial adjustment at the middle point of the curve when the vehicle negotiates a bend.

Figure 9:
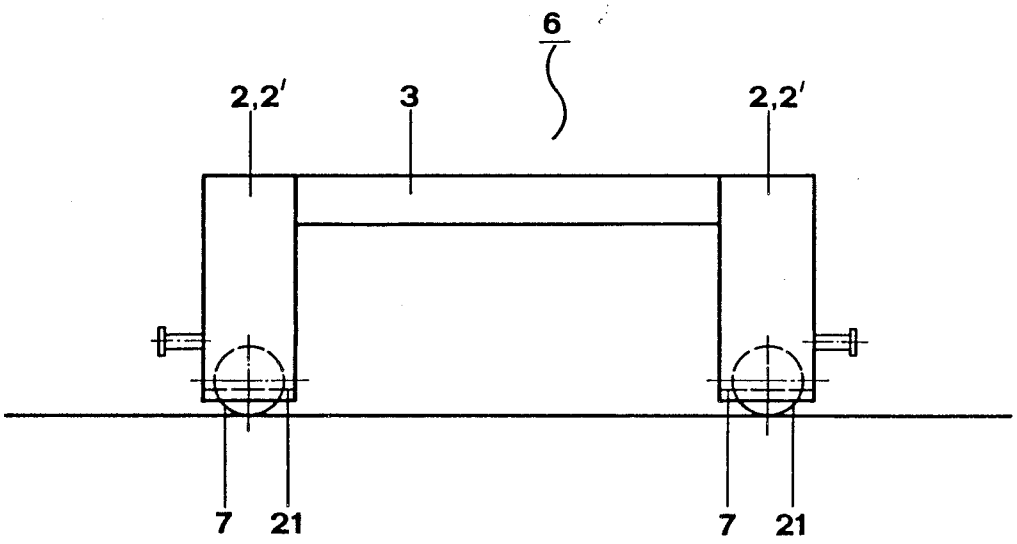
FIG. 9 is a gantry chassis of a track vehicle according to FIG. 1 without a passenger-freight compartment.

FIG. 9 shows a gantry frame 6 of a track vehicle according to FIG. 1 without the passenger or freight compartment. The frame consists essentially of two driven single wheel chassis 2 or two non-driven single wheel chassis 2', or one driven and one non-driven single wheel chassis, in combination with a support and service unit 3 forming the gantry frame 6 and the whole forms a self-supporting transportable unit for receiving a container-like passenger compartment 1 or freight compartment 1'.

Such a gantry frame permits the formation of a track vehicle having an extremely low vehicle floor over the complete vehicle length, whereupon two driven single wheel chassis or two non-driven single wheel chassis, or one driven single wheel chassis and one non-driven single wheel chassis together with the support and service unit can form a gantry frame, which is capable of receiving an essentially container-like passenger or freight compartment and by which the extremely low vehicle floor may be continued even in the region of the gantry-like, driven single wheel chassis and non-driven single wheel chassis by virtue of trough-like shapes between the wheels.

The support and service unit of the gantry frame serves to receive the entire driving mechanisms, such as propulsion equipment, coolers, electrical and compressed air apparatus, wheel steering units, water purification etc. On both ends of the gantry chassis, end units can be provided which if necessary may have an extremely low vehicle floor and optionally may contain an entrance, driver cab, bathroom or telephone station and the end walls may be provided with a attachment means acting as connection elements to the next adjacent vehicle.

With the above-mentioned vehicle construction it is possible, by the use of a gantry carriage with driven single wheel chassis and/or non-driven single wheel chassis, of substantially the same construction, to realize a single vehicle configuration which is suitable for all purposes, and which may consist of several vehicle parts attached together via joints. These track vehicles boast convenient outer boarding heights and an extremely low, continuous vehicle floor, good straight line running as well as a markedly good operation in a curve and resistance to wear.

A particular advantage of the use of driven single wheel chassis in such a gantry frame is that it enables the track vehicle to have an axial drive which gives to the vehicle a high acceleration potential.

Such a vehicle runs quietly not only because of the radial adjustability of its wheels when going around curves, but also because of the overhead arrangement of the motor and various noise sources in the support and service unit which assists a funnelling of the sound upwards.

By the location of the drive and other apparatus in the support and service unit, i.e. the roof region of a vehicle, the center of gravity of the vehicle is raised, which is compensated for by the high level secondary suspension.

The extremely low vehicle floor, which normally lies at a level below the middle points of the wheels and is trough shaped in the region of the driven or non-driven single wheel chassis, may extend over the entire length of the vehicle, which makes the use of entrance steps superfluous and produces a flat vehicle floor which has a desirable effect on wind resistance and winter safety.

The invention permits high speeds in curves and is therefore best suited for combination with an active or passive transverse inclination of the vehicle body.

The use of the illustrated vehicle construction is also suitable for double deck vehicles for reasons based on its profile.

For passenger trains, the circulation of mobile serving carts within the train is facilitated by the flat vehicle floor.

The invention is suitable for all track gauges, for main line and local traffic, and is particularly suited for a gauge change drive.

In this case, the track holder mentioned above of a driven single wheel chassis or a non-driven single wheel chassis is adjustably arranged and is consequently in the position to accommodate various track widths.

When passing through a track interchange apparatus (i.e. a location in which the tracks are so laid that they smoothly change from one track width to another), the track holder is correspondingly automatically adjusted and locked, and the single wheels brought into a camber position about an elevated pivot point, e.g. in the region of the secondary suspension.

The camber position of the single wheels can be directed both inwardly or outwardly, whereby the change of the wheel cambers is also accommodated by an appropriate construction of the angle drive.

I claim:

1. In a track vehicle having a body with opposite sides, a roof region and wheels arranged in pairs with the wheels of each pair arranged at opposite sides of the body, the improvement which comprises a gantry-like frame comprising support members extending substantially upwardly from the wheels adjacent to the body sides and a cross member located extending between the support members in the roof region of the body;

wherein propulsion means is provided in the roof region of the vehicle body and at least one of said wheels is connected to the propulsion means via a rotatable drive shaft extending within the support member associated with said at least one wheel.

2. In a vehicle having a body with opposite sides, a roof region and wheels arranged in pairs at opposite sides of the body, the improvement which comprises:

a gantry-like frame comprising support members extending substantially upwardly from the wheels adjacent to the body sides and a cross member located between the support members in the roof region of the body;

wherein said support members have lower ends and upper ends, and said vehicle body is supported on said wheels by means of primary suspensions located adjacent to the lower ends of said support members, and said vehicle body is also supported on said gantry-like frame by means of secondary suspensions adjacent to the upper ends of said support members; and wherein propulsion means is provided in the roof region of the body and connected to at least one of said wheels for driving the same;

said propulsion means has weight which raises the center of gravity of said vehicle; and said secondary suspensions adjacent to the upper ends of the support members provide for compensating for said weight of the propulsion means.

3. A track vehicle comprising a body with opposite end regions; two opposite sides; a roof in a roof region extending between the sides; and a wheel assembly at each end region, each said wheel assembly comprising at least two wheels which are each mounted on a respective single-wheel chassis; and a gantry-like frame which includes:

a pair of support means, each extending substantially upward from one of said wheel assemblies; including means for securely interconnecting said at least two single-wheel chassis of said respective wheel assembly; and for supporting said body sides and said roof;

said vehicle further comprising a floor which extends substantially on a constant level from one said end region to the other and between the wheels, said floor level being below the tops of the wheels;

wherein each said support means includes a substantially vertical support member mounted to each said wheel; and a cross member in the roof region interconnecting said support members;

wherein said wheels support said support members and are connected to said support members by pivotal means for allowing for limited steerability of the wheels;

wherein the wheels of each said pair are interconnected by at least one link means which determines the spacing between said wheels and keeps said wheels substantially parallel;

wherein each said wheel is supported by respective chassis means, and wherein each said chassis means supports a respective one of said support members; and wherein said link means comprises a pair of gauge rods which are pivotally attached to front and rear portions of both of said chassis means, and further comprising a pair of guide levers, each of which is pivotally connected to one of said chassis means and to said vehicle body.

4. An articulated combination comprising:

at least a first track vehicle comprising a body with opposite sides, a roof in a roof region, and wheels arranged in pairs, with the wheels of each pair arranged at opposite sides of the body; a gantry-like frame comprising support members extending substantially upwardly from the wheels adjacent to the body sides and a cross member located extending between the support members in the roof region of the body; and a floor extending from one end of the vehicle to the other at a substantially constant level between and below the tops of the wheels;

wherein said wheels support said support members and are connected to said support members by pivotal means for allowing for limited steerability of the wheels; and wherein the wheels of each said pair are interconnected by at least one link means which determines the spacing between said wheels and keeps said wheels substantially parallel;

said articulated combination further comprising an intermediate vehicle part coupled to said first vehicle, having a body and at least a pair of wheels arranged on opposite sides thereof; and means for interconnecting the wheels of said intermediate vehicle part with the body of said first vehicle for steering said wheels of said vehicle part in response to changes in alignment between said first vehicle and said vehicle part.

5. A combination according to claim 4, further comprising a second track vehicle also coupled to said intermediate vehicle part; and means for interconnecting the wheels of said intermediate vehicle part with the body of said second vehicle, for steering said wheels of said vehicle part in response to changes in alignment between said second vehicle and said vehicle part.

6. A combination according to claim 4, wherein said wheels of said intermediate vehicle part are interconnected by a track holder which determines their spacing and keeps them substantially parallel; and further comprising a pair of guide levers which are each pivotally connected to a respective end of said track holder adjacent said wheel, and further connected to said body of said vehicle part.

7. A combination according to claim 6, further comprising a second said pair of wheels in said intermediate vehicle part.

8. A combination according to claim 4, wherein said connecting means comprises a steering lever pivotally connected to said body of said first vehicle and said body of said vehicle part.

9. A combination according to claim 4, wherein said connecting means comprises a steering lever pivotally connected to said body of said first vehicle and said track holder of said vehicle part.

* * * * *